US008117735B2

(12) United States Patent
Engler et al.

(10) Patent No.: US 8,117,735 B2
(45) Date of Patent: Feb. 21, 2012

(54) TWO PIECE BI-METAL COIL TERMINAL AND ELECTRICAL COIL ASSEMBLY INCORPORATING SAME

(75) Inventors: Kevin J. Engler, St. Charles, IL (US); Jeff M. Griswold, Savanna, IL (US); Mark A. Hentschel, Elburn, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 0 days.

(21) Appl. No.: 12/980,467

(22) Filed: Dec. 29, 2010

(65) Prior Publication Data

US 2011/0088252 A1 Apr. 21, 2011

Related U.S. Application Data

(62) Division of application No. 11/849,653, filed on Sep. 4, 2007, now Pat. No. 7,884,693.

(51) Int. Cl.
*H01F 7/06* (2006.01)

(52) U.S. Cl. ..... 29/602.1

(58) Field of Classification Search ..... 336/192, 336/196, 198; 29/602.1, 618, 619, 747, 837, 29/842

See application file for complete search history.

(56) References Cited

U.S. PATENT DOCUMENTS

| | | | | |
|---|---|---|---|---|
| 2,963,678 | A | 12/1960 | Wolf et al. | |
| 4,028,654 | A | 6/1977 | Bullard et al. | |
| 4,954,801 | A | 9/1990 | Urbanski et al. | |
| 4,975,739 | A | 12/1990 | Noda | |
| 5,111,175 | A | 5/1992 | Sugiura et al. | |
| 5,153,550 | A | 10/1992 | Sugiura et al. | |
| 5,210,928 | A | 5/1993 | Seshita et al. | |
| 5,331,730 | A * | 7/1994 | Brinn, Jr. | 29/606 |
| 5,426,410 | A * | 6/1995 | Niimi | 336/192 |
| 5,977,852 | A | 11/1999 | Schoettl | |
| 6,118,361 | A | 9/2000 | Ogawa | |
| 6,160,468 | A | 12/2000 | Himei | |
| 6,680,666 | B1 | 1/2004 | Lopez et al. | |
| 6,864,775 | B2 | 3/2005 | Lopez et al. | |
| 7,036,225 | B2 | 5/2006 | Goto | |
| 7,928,822 | B2 * | 4/2011 | Suzuki et al. | 336/198 |

* cited by examiner

*Primary Examiner* — Tuyen Nguyen
(74) *Attorney, Agent, or Firm* — Reinhart Boerner Van Deuren P.C.

(57) ABSTRACT

An electrical coil assembly utilizing a bi-metallic two-piece terminal construction and a method of manufacturing same are provided. The inner terminal structure utilizes a material that aids in the touchless attachment of the fine gauge magnetic wire to the inner terminal structure. The low mass of the inner terminal structure allows for increased winding speeds during the manufacturing process. The outer terminal structure utilizes a material that provides good corrosion resistance and electrical conductivity. The inner and outer terminal structures are electrically attached after the winding and electrical attachment process of the fine gauge magnetic wire. The coil and two-piece terminal connectors may then be encapsulated to provide a final electrical coil assembly.

2 Claims, 7 Drawing Sheets

TWO PIECE BI-METAL COIL TERMINAL AND ELECTRICAL COIL ASSEMBLY INCORPORATING SAME

CROSS-REFERENCE TO RELATED PATENT APPLICATION

This patent application is a Divisional of co-pending U.S. patent application Ser. No. 11/849,653, filed Sep. 4, 2007, the teachings and disclosure of which are incorporated herein in their entireties by reference thereto.

FIELD OF THE INVENTION

The present invention relates generally to electrical terminal connections, and more specifically to electrical terminal connections for use in electrical coils.

BACKGROUND OF THE INVENTION

Typical modern appliances often employ electrical control circuits to regulate operation thereof. These electrical control circuits typically include both digital controls that control the operational programming of the appliances, as well as electro-mechanical components for actually controlling the opening and closing of valves, door locks, etc. in the appliance. The control of these electro-mechanical devices, for example solenoid control valves, is accomplished by energizing an electrical coil to create a magnetic field that moves a plunger or other type of valve stem to open or close the valve. When the electrical coil is de-energized, a spring is often used to return the plunger or valve stem to its starting or quiescent position.

Because there has been a significant volume increase in the demand for such electro-mechanical components, the demands on manufacturers of such components from both a price and reliability standpoint have increased significantly as well.

The typical electrical coil used on water valves in the appliance industry includes a molded plastic spool. This molded spool typically includes molded-in or otherwise attached electrical contacts that will serve as the electrical interface to the control circuitry. To keep the size of the electrical coil small, a very fine gauge magnetic wire is then wound on the spool. The number of windings on the coil can vary, but typically includes several thousand windings to generate sufficient magnetic force within the center of the spool to properly actuate the plunger or valve stem. To achieve this large number of windings efficiently, an automatic winding machine is used to wind the wire onto the molded spool.

Each end of the coil of wire wound on the spool is attached to one of the two electrical terminals during the manufacturing process. Typically, each end of this fine gauge wire is soldered onto one of the two electrical terminals. Unfortunately, since the soldering process requires physical touching of the wire, there is risk during this process that the wire may be weakened or broken. This is particularly problematic in coils that are encapsulated after the winding and terminal attachment processes are complete because the process of encapsulation itself typically causes stress on the wire at the connection point. Therefore, the damage may not be readily apparent until the entire manufacturing process of the coil is completed. A rejection of this point is quite costly to the manufacturer as the entire encapsulated coil must be scrapped.

There exists, therefore, a need in the art for improved method of manufacturing electrical coils that reduces the reject rate resulting from soldered connection failures between the electrical terminals and the fine gauge magnetic wire.

BRIEF SUMMARY OF THE INVENTION

Embodiments of the present invention provide new and improved electrical coils and methods of manufacturing same. More particularly, embodiments of the present invention provide new and improved electrical coils having improved connection between the electrical terminals and the fine gauge magnetic wire used to construct the coil. Embodiments of the method of manufacturing such coils utilize touch-less attachment processes for securing the fine gauge magnetic wire to each of the electrical terminals of the coil assembly. Embodiments of the present invention utilize electrical terminal structures that allow for increased winding speed during the coil construction winding operation resulting in greater productivity and output from current manufacturing operations.

In one embodiment of the present invention an electrical coil utilizes a two-piece construction for each of the two electrical connectors. The inner terminal structure to which the fine gauge magnetic wire is attached is small in size and low in mass which supports improvement in the winding and attachment processes. In one embodiment the attachment process utilized is arc welding of the fine gauge magnetic wire to the inner terminal structure. The outer terminal structure may be attached to the inner terminal structure after the winding and terminal connection processes are complete, prior to the encapsulation of the entire assembly.

In one embodiment the inner and outer terminal structures utilize different materials. The inner terminal structure preferably utilizes a material which has a high level of purity and is of approximately the same melting point as the fine gauge magnetic wire to facilitate an arc welding attachment process. In one embodiment the material for the inner terminal structure is phosphor bronze. The material for the outer terminal structure is a good conductor that is not readily oxidizable when exposed to the environment in which the coil assembly is used. In one embodiment this material is brass. In such an embodiment utilizing dissimilar metals, the attachment process for the inner and outer terminal structures may be, for example, resistance welding.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
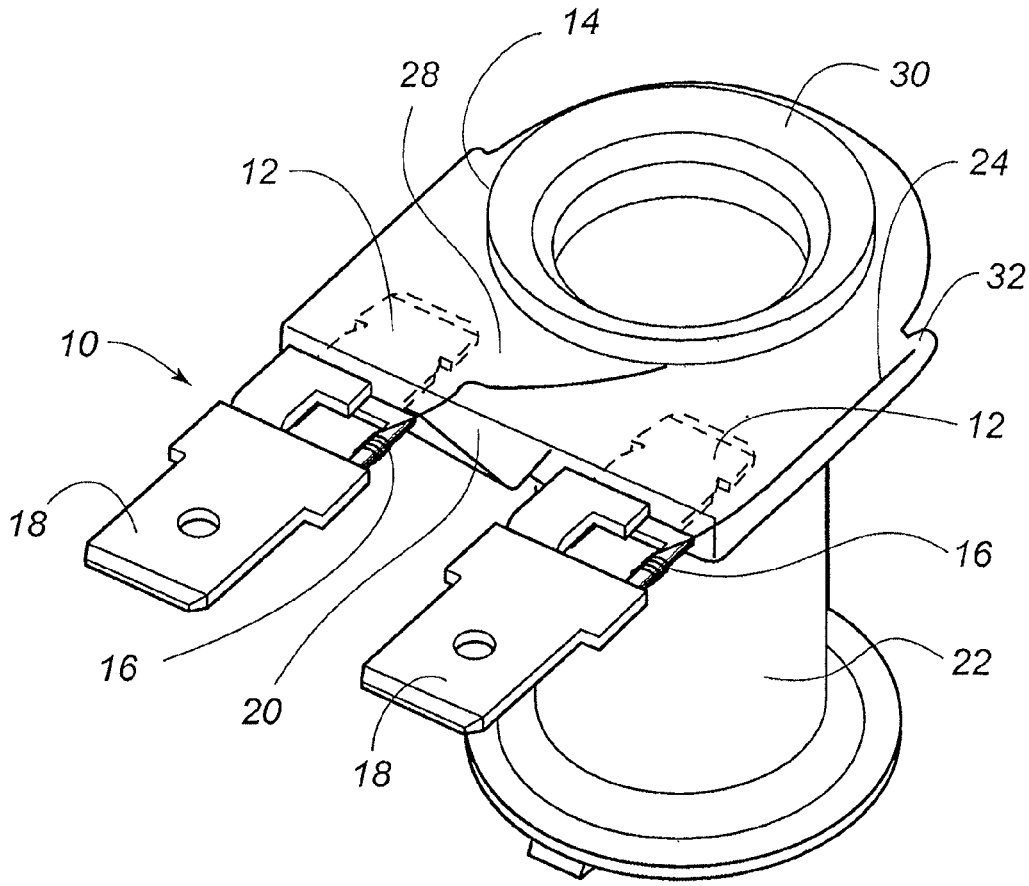
FIG. 1 is an isometric illustration of an embodiment of an electrical coil constructed in accordance with the teachings of the present invention illustrating the connection and wire routing paths for the fine gauge magnetic wire.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In the following description, various embodiments of the present invention will be described with regard to their use for appliance water valve or other solenoid operated devices that are particularly well suited to the appliance industry. However, those skilled in the art will recognize from the following description that such embodiments and operating environments are provided by way of example only, and not by way of limitation. Further, this description will include disclosure of internal workings, experimentation and conclusions reached by the inventors, and such description should not be taken as an admission or otherwise as an indication that others skilled in the art would have identified similar problems or followed a similar path in the conception of the present invention.

In trying to overcome the high rejection rate resulting from failed connections due to damage incurred by the fine gage magnetic wire during the terminal attachment soldering process, it was determined that a touchless attachment process would be attempted to determine if the damage problem of the fine gage magnetic wire could be overcome, thereby decreasing the rejection rate. One potential solution for a touchless attachment process is to utilize arc welding to form the physical attachment between the fine gage magnetic wire of the coil and the electrical terminals. Indeed, such an arc welding process also addresses the environmental issues associated with a typical soldering process.

An arc welding process requires that the materials to be arc welded together have approximately the same melting point. Given the fine gage magnetic wire used to wind the coils, an appropriate electrical terminal material needed to be identified. Based on the composition of the fine gage magnetic wire, phosphor bronze was selected as an appropriate material for the electrical terminal because of its high level of purity and melting point being approximately equal to that of the fine gage magnetic wire used to wind the coil. Preferably, the material is phosphor bronze C510, although phosphor bronze C511 and C521 may also be used. Alternatively, copper may be used for the electrical terminals. In such embodiments, the preferred material is copper 194, although copper 195, 197 and possibly 110 and 102 may also be used.

While the use of phosphor bronze allows for the arc welding of the fine gage magnetic wire to the electrical terminal to substantially reduce the failure rate of this connection as experienced in the soldering process, it was determined that phosphor bronze suffers from some significant disadvantages. Specifically, phosphor bronze tends to deteriorate when exposed to air by forming an oxidation layer on the surface thereof. This oxidation layer is unattractive in appearance and reduces the conductivity of the electrical terminal, and therefore the reliability over time. Additionally, phosphor bronze is significantly more expensive than other electrical terminal contact metals, such as brass, by a ratio of 2 or 3 to 1. While phosphor bronze may be plated to overcome the deterioration and aesthetic issues, such plating process adds an additional manufacturing step, potentially contaminates the weld connection and adds associated increased costs to the overall assembly.

These are some of the reasons why brass is typically used for the electrical connectors on such coils, i.e. it is a good electrical conductor, it is not readily oxidizable, and is significantly less expensive than materials such as phosphor bronze. However, based on the melting point of the constituents of brass, a soldering process is recommended to attach the fine gage magnetic wire to brass terminal connectors, which as discussed above, has resulted in higher than acceptable rejection rates due to damage to the fine gage magnetic wire.

To resolve all of these conflicting problems, the inventors took an unconventional approach to resolve them all in a cost effective electrical terminal construction that allows for touchless arc welding while at the same time provides a corrosion resistant electrical terminal that is cost efficient.

In one embodiment of the present invention as illustrated in FIG. 1, a two piece electrical terminal connector assembly 10 is provided. This two piece terminal connector assembly 10 utilizes a small inner terminal structure 12 that may be partially molded into or otherwise positioned partially within the spool 14. Preferably, this inner terminal structure 12 is constructed from phosphor bronze or other appropriate material to allow touchless securing of the fine magnetic wire 16 thereto. Since this inner terminal structure 12 is sized appropriate to its required function, the overall cost of the electrical terminal connector assembly 10 is reduced compared to using, e.g. phosphor bronze, for the entire electrical terminal.

While the present invention was designed to overcome the wire to electrical connector contact failure problem, it soon became apparent that the two piece electrical connector assembly 10 provided an unforeseen benefit. Specifically, because the low mass phosphor bronze inner terminal structure 12 is small and only extends beyond the spool 14 a short distance, there results a significant reduction in the vibration-causing imbalance typically associated with winding the coil with the electrical terminals installed therein. As such, winding speeds may be increased significantly, e.g. up to approximately 33 percent over winding speeds of spools having installed therein traditional one piece electrical terminals. This significantly reduces the manufacturing time and therefore expense of each individual coil assembly, resulting in greatly enhanced throughput in the manufacturing facility. This is possible because the wire attachment and winding operation may be accomplished with only the inner terminal structure 12 in the spool 14.

Once the first end of the electrical coil has been attached to one of the inner terminal structures 12, the spool 14 has been fully wound, and the second end of the coil has been attached to other inner terminal structure 12, the two piece electrical terminal connector assembly 10 may be completed by attaching the outer terminal structure 18 to the inner terminal structure 12. As discussed above, this outer terminal structure 18 may be made from a more corrosion resistant and lower cost material from the inner terminal structure 12, for example, brass. Because the outer 18 and inner 12 terminal structures are dissimilar materials having differing melting points, they may be attached through, for example, a resistance welding process. Such an attachment process is preferable over, for example, a welding process because it substantially reduces the fuming caused by the low melting point constituents of the dissimilar metal associated therewith.

Figure 5:
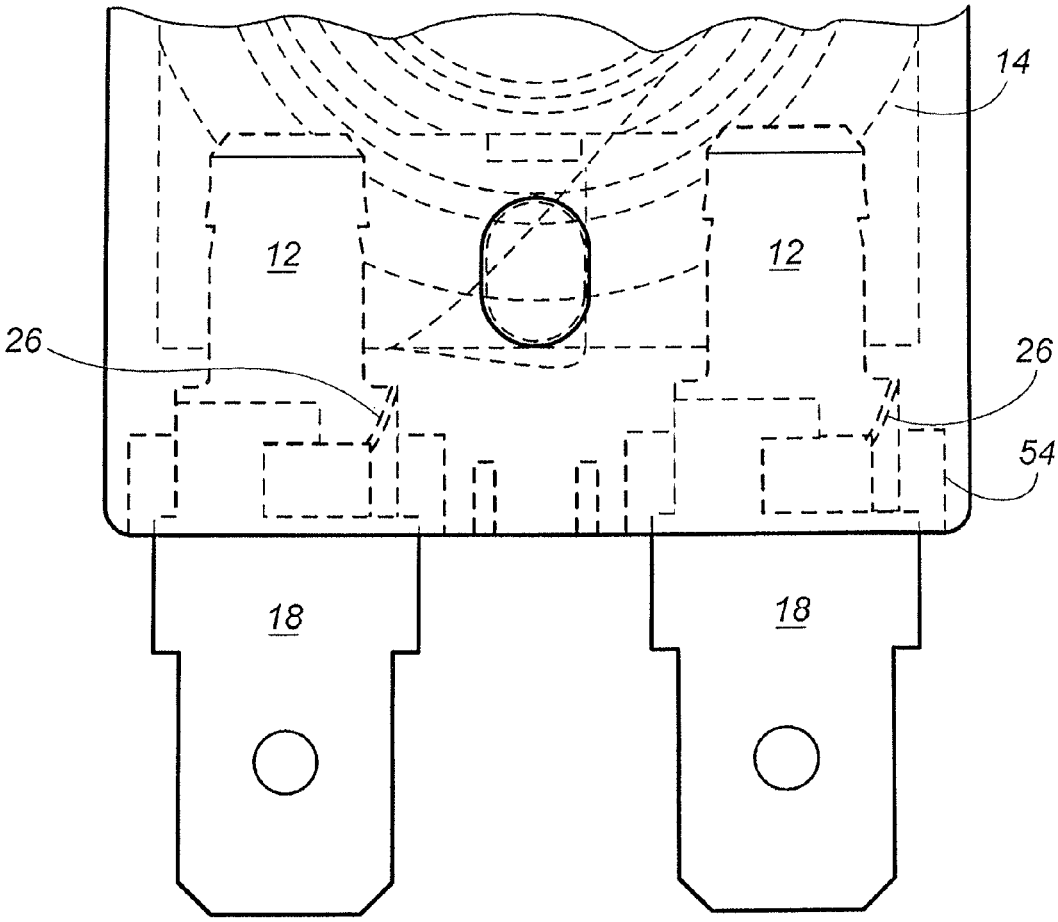
FIG. 5 is a top view illustration of the two-piece electrical connectors in accordance with one embodiment of the present invention.

As may also be seen from the illustration of FIG. 1, the spool 14 includes a start wire way 20 formed in the spool 14 for receiving and guiding the fine gauge magnetic wire 16 from its connection point on the inner terminal structure 12 to the winding surface 22 of the spool 14. Once the spool winding has been completed, the magnetic wire of the coil 16 is then guided by a finish wire way 24 to its contact position on the other inner terminal structure 12. This proper wire placement is aided in one embodiment of the inner terminal structure terminal structure 12 by a wire guide groove 26 as best seen in the illustration of FIG. 5.

Returning again to FIG. 1, it may be seen that in the illustrated embodiment the start wire way 20 is formed by a slit in the inner surface of the electrical terminal mounting section 28 of the spool 14. This slit preferably has an outer most termination point near the edge of the inner terminal structure 12 and traverses an angled path so as to position the magnetic wire 16 in an approximate tangential relation to the surface 22 of spool 14 onto which it is to be wound. In this way the gentle redirection of the wire from its mounting position on the inner terminal structure 12 to its initial winding position on spool 14 occurs without adding any stress onto the wire that may result in weakness or other damage thereto. The finish wire way 24 is preferably formed on the outer surface of end portion 30 of spool 14. To aid in the proper placement of the magnetic wire into the finish wire way 24, the end 30 includes wire catch 32 that helps hold the wire in proper position for guidance along the finish wire way 24. In an alternate embodiment, the finish wire way 24 is positioned in the side edge of end 30 as opposed to along the top of end 30.

Figure 2:
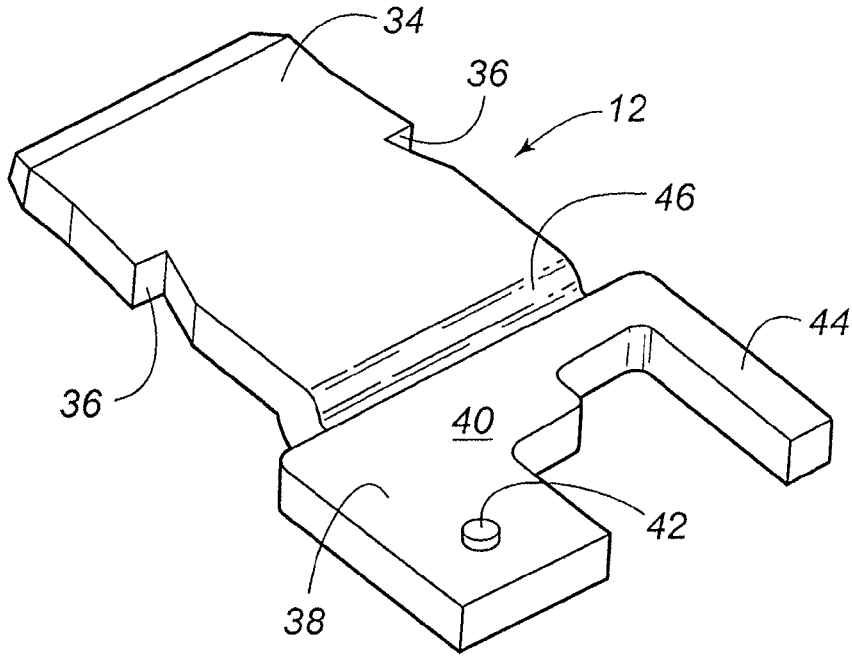
FIG. 2 is an isometric illustration of one embodiment of the inner terminal structure used in the embodiment illustrated in FIG. 1.

Details of the inner terminal structure 12 may be seen in the isometric illustration of FIG. 2. This inner terminal structure 12 includes a first portion 34 that is inserted, embedded, or molded into the spool 14. This portion 34 includes notches 36 which aid in retaining the inner terminal structure 12 within the spool 14 during the manufacturing process. The inner terminal structure 12 also includes a portion 38 which is exposed from the spool 14 during the manufacturing process. This portion 38 includes a surface portion 40 to which the outer terminal structure 18 will be attached. In an embodiment wherein resistance welding is used as the attachment process, the portion 38 may include a welding projection 42 that will mate with a corresponding structure on the mating surface of the outer terminal structure 18. Portion 38 also includes a winding post 44 onto which the magnetic wire will be wound prior to final attachment by the arc welding process. As illustrated in the embodiment of FIG. 2, between portions 34 and 38 the inner terminal structure 12 includes a stepped transition surface 46 that provides an offset between the planes of portion 34 and portion 38. In one embodiment this offset is approximately half the material thickness of the inner terminal portion 12 so as to facilitate symmetry of the overall terminal construction as illustrated in the side view of the completed terminal construction of FIG. 4.

Figure 3:
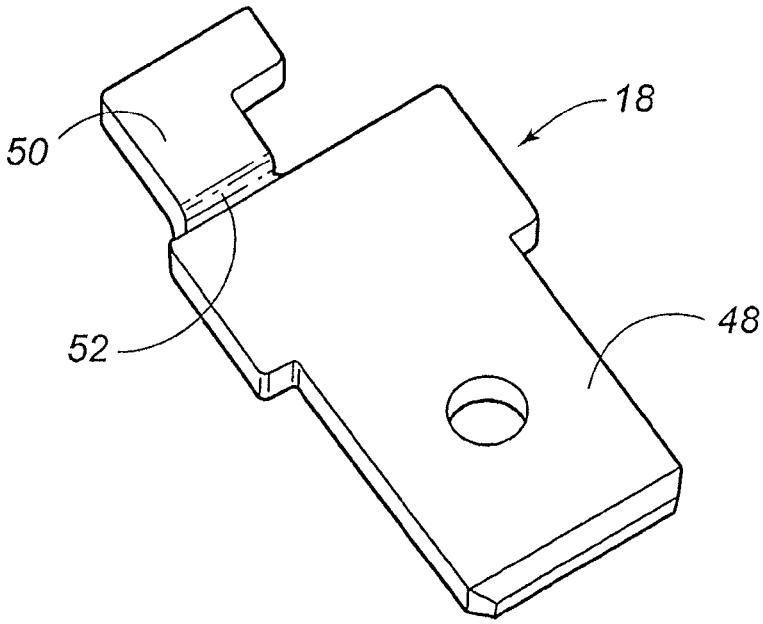
FIG. 3 is an isometric illustration of one embodiment of an outer terminal structure used in the embodiment illustrated in FIG. 1.
Figure 8:
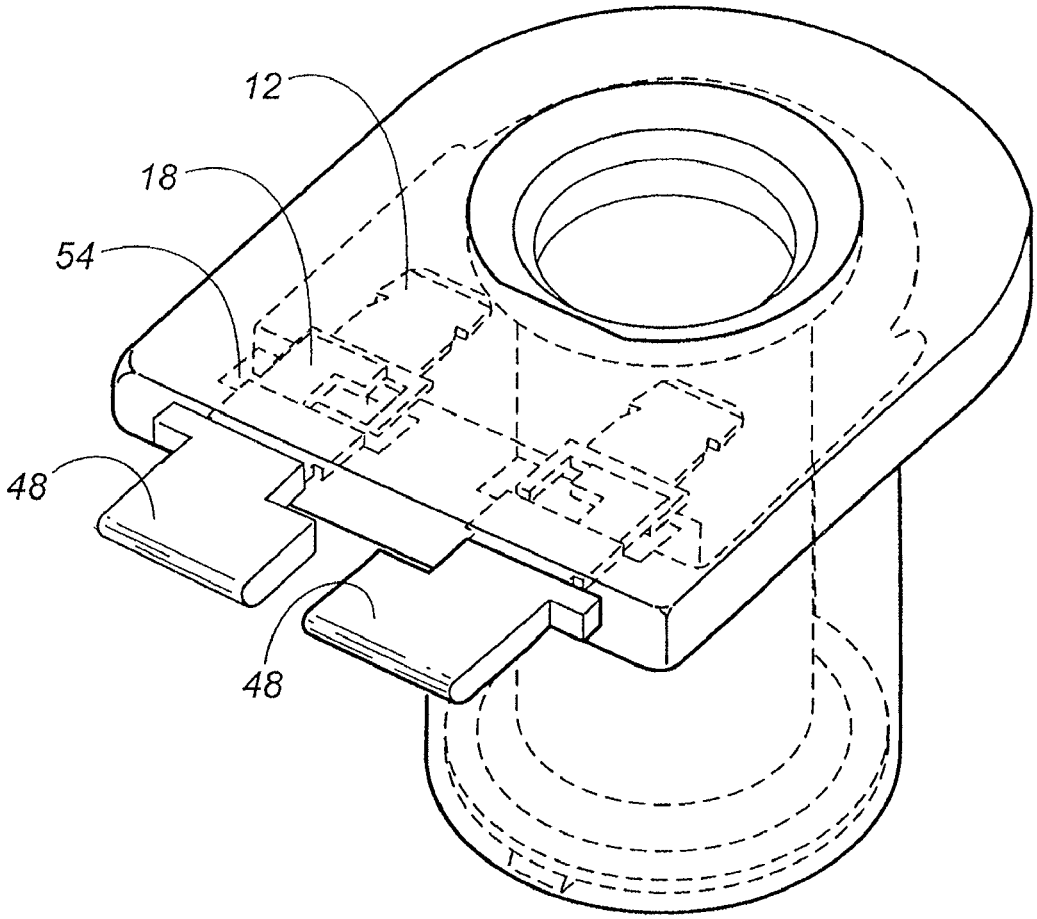
FIG. 8 is an isometric illustration of an alternate embodiment of an electrical coil utilizing an alternate configuration for the outer terminal structure.

FIG. 3 illustrates an embodiment of the outer terminal structure 18. This outer terminal structure 18 includes an electrical connector portion 48 that may be configured as desired for the type of electrical connection that will be used to connect to the finished electrical coil assembly. One example of an alternate connector portion 48 may be seen in the illustration of FIG. 8 wherein an alternate Rast-type connection is used.

Returning to FIG. 3, the outer terminal structure 18 also includes a connection portion 50, the under surface of which will connect to surface 40 of the inner terminal structure 12 illustrated in FIG. 2. While not visible in FIG. 3, portion 50 will include a mating structure to accommodate welding projection 42 illustrated in FIG. 2. FIG. 3 also illustrates the offset transition surface 52 positioned between portions 48 and 50.

Figure 4:
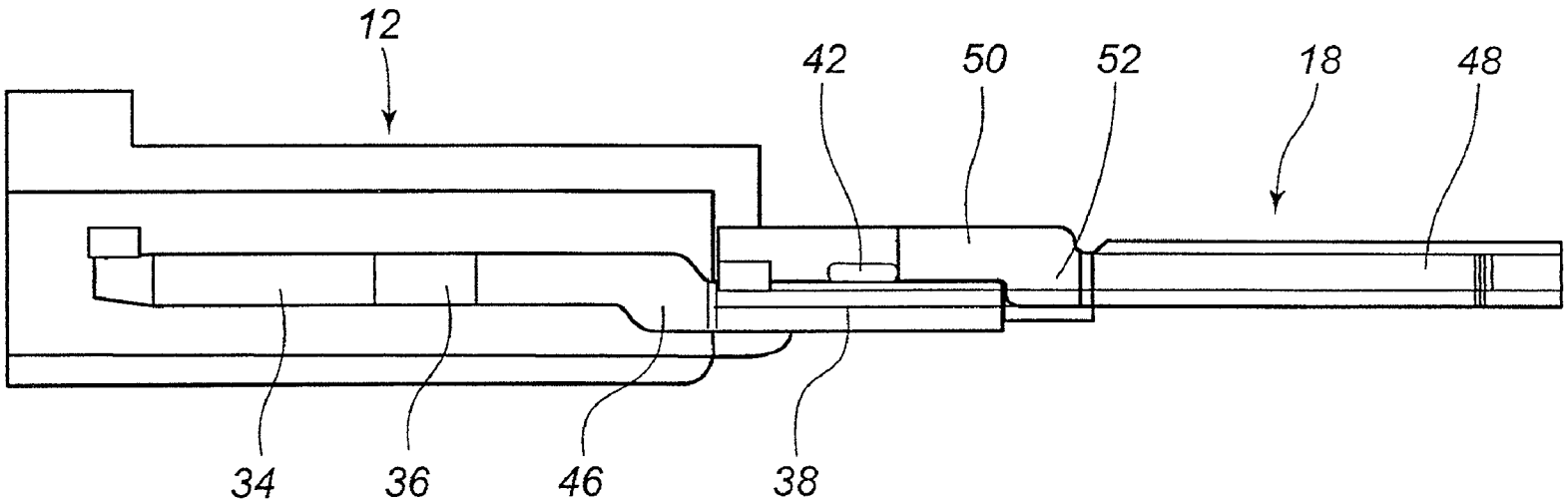
FIG. 4 is a side view illustration of the two-piece terminal assembly illustrated in the embodiment of FIG. 1.

This surface 52 provides a complimentary offset between the planes of portion 50 and 48 so that when attached to the inner terminal structure 12 as illustrated in FIG. 4, symmetry of the overall terminal construction may be maintained. In the illustrated embodiment, the small offset is of half of its material thickness facilitating centerline symmetry of the final constructed terminal. The symmetry displayed in FIG. 4 also allows those skilled in the art to flip the inner terminal orientation, positioning the winding post 44 (see FIG. 2) to alternative positions with respect to the start and finish wire ways 20 and 24 (see FIG. 1). This alternative alignment approach offers design flexibility in the position of the wire ways in the construction of the bobbin 14. This approach also offers flexibility in the use of said wire ways during coil manufacturing because of process speed and convenience.

As may now be apparent to those skilled in the art from the foregoing description, one embodiment of the process to manufacture such an electrical coil begins by molding, inserting, or pressing the inner terminal structure 12 into the plastic bobbin or spool 14. The magnetic coil wire is then wound around the winding post 44 of the inner terminal structure 12 positioned next to the start wire way 20. The wire 16 is then strung through the start wire way 20 to facilitate winding of the core. After the coil winding has been completed, the wire 16 is then returned to the other inner terminal structure 12 via the finish wire way 24 and is wrapped around the winding post 44 of the other internal terminal structure 12. The wires are then joined to the terminals using arc welding at the tip of the wire winding posts 44 of each of the inner terminal structures 12. The outer terminal structures 18 are then positioned on the inner terminal structure 12 and welded using a resistance weld or other suitable process to join the two terminal pieces 12, 18 together.

The subassembly is then encapsulated with an over molding material sealing the terminal connection inside the plastic shell, providing environmental protection to the components thereof. This over molded plastic shell 54 and the extent thereof in one embodiment may be seen from the illustration of FIG. 5. In such an embodiment the wire connections and routings are protected, as well as the phosphor bronze material which otherwise would undergo deterioration as discussed above. A portion of the outer terminal structure 18 is also encapsulated within the plastic shell 54 which also aids in the retention and support thereof. In one embodiment a portion of the connection portion 50 (see FIG. 3) includes an L-shaped projection which aids in the retention of the outer terminal structure 18 after encapsulation within the plastic shell 54.

Figure 6:
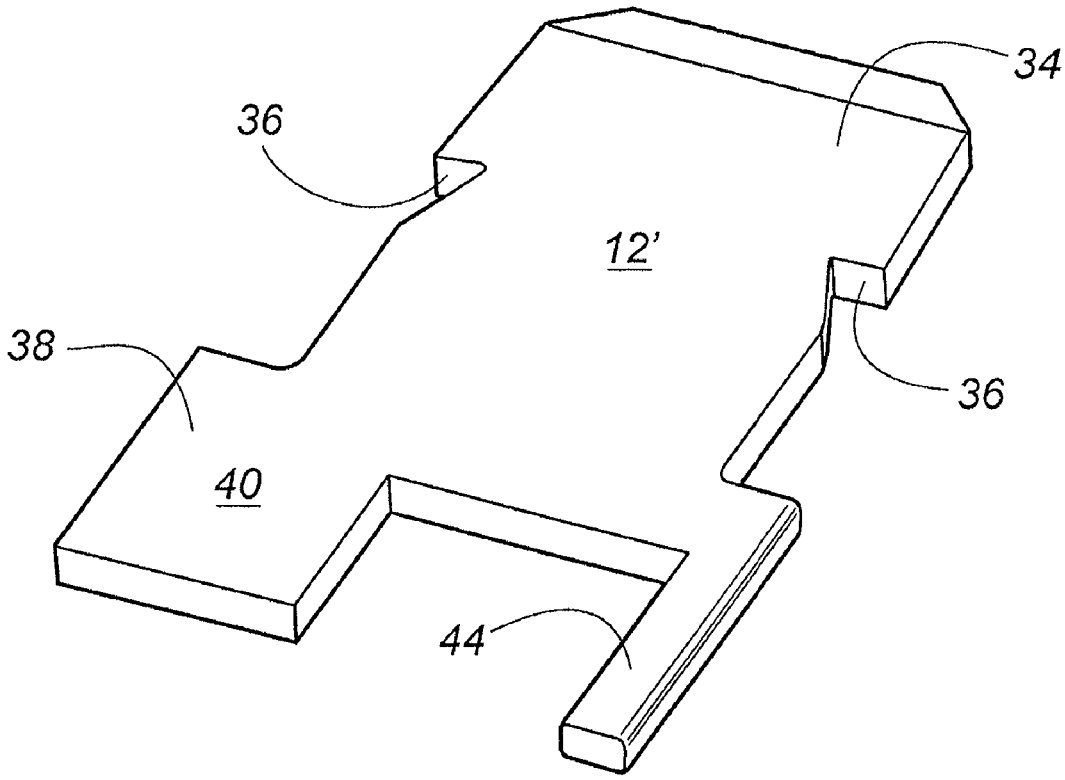
FIG. 6 is an isometric illustration of an alternate embodiment of an inner terminal structure.
Figure 7:
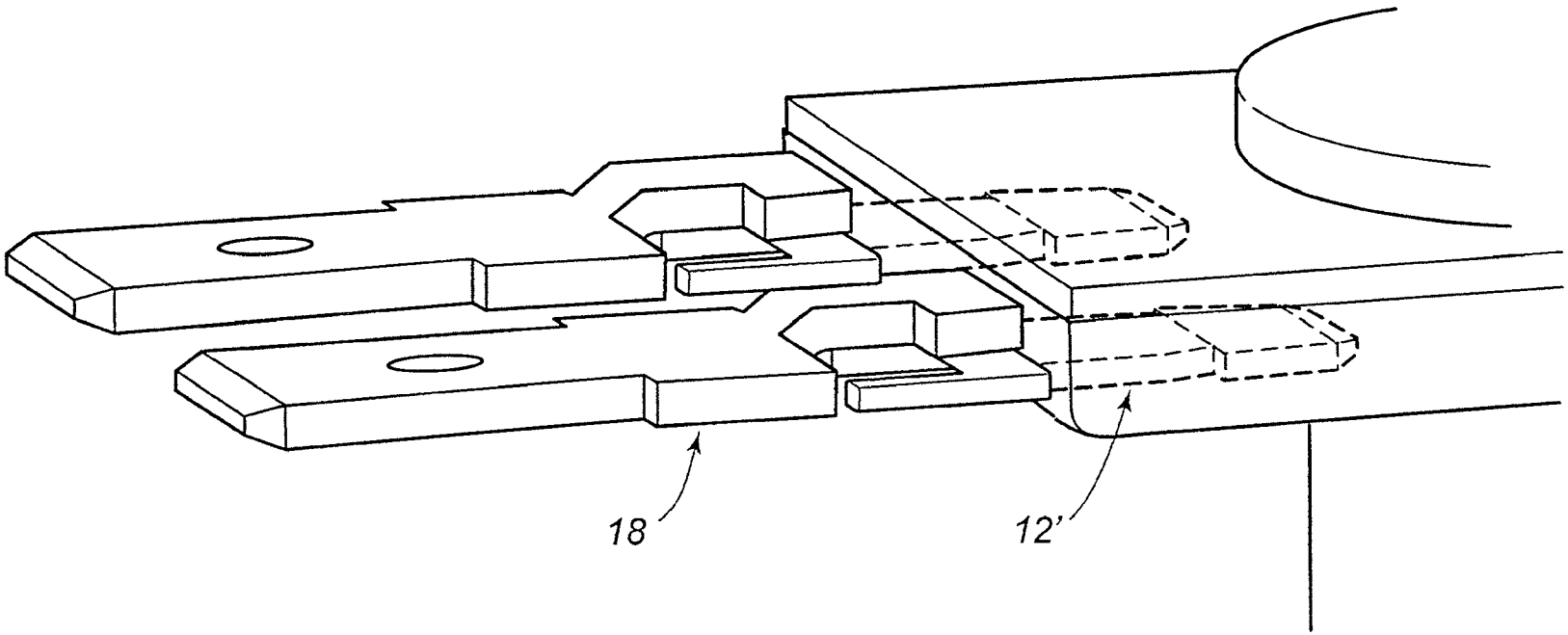
FIG. 7 is an isometric side view illustration of an alternate embodiment of the two-piece terminal construction utilizing the inner terminal structure of FIG. 6.

FIG. 6 illustrates an alternate inner terminal structure 12 design that utilizes a thin planar construction. Such a thin planar construction eliminates the need for the offset transition surface 46, i.e., the step illustrated in FIG. 2 is removed. This thin planar structure may still be used with the outer terminal structure 18 illustrated in FIG. 3 as illustrated in FIG. 7. However, to maintain the same outer terminal position the thin planar inner terminal structure of FIG. 6 is shifted slightly downward in its mounted position in the spool 14 as opposed to when the embodiment of inner terminal structure 12 illustrated in FIG. 2 is utilized. This orientation and interface with the outer terminal structure 18 is illustrated in FIG. 7.

As may now be apparent to those skilled in the art from the foregoing description, embodiments of the present invention eliminate the need for soldering of the coil wire connection which addresses both the prior failure issues as well as environmental issues. Such embodiments also provide design and material choice flexibility for the outer connection terminal, which reduces the impact of change and adds design flexibility to the end user. Embodiments also address the issue of cost by minimizing the use of the higher cost material needed for arc welding and by maximizing the use of lower cost outer terminal material. Encapsulation contains and protects the inner terminal material which addresses the corrosion issue associated with the use of such material.

From the manufacturing standpoint, use of the compact, low mass inner terminal facilitates faster bobbin winding speed, allows for shorter arbor-to-arbor spacing, and results in fewer wire breaks from bulky terminal interference. This smaller inner terminal design also provides improved access for the wire wrapping nozzle, and illuminates the need for winding arbors and load racks that are dedicated to different external terminal design configurations. Further, since embodiments of the present invention reduce the distance to the wire ways the overall design is more robust. Additionally, the common winding configuration lends itself very well to just in time manufacturing techniques since the final terminal connection is not committed until after the winding process has been completed.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of making an electrical coil assembly, comprising the steps of:

supplying a spool having an electrical terminal mounting section;

attaching a first and a second inner terminal structure of a first material to the terminal mounting section;

wrapping a first end of a wire on the first inner terminal structure;

winding the wire on the spool;

wrapping a second end of the wire on the second inner terminal structure;

arc welding the first end of the wire on the first inner terminal structure;

arc welding the second end of the wire on the second inner terminal structure;

attaching a first and a second outer terminal structure of a second material different from the first material of the inner terminal structures to the first and the second inner terminal structures, respectively; and encapsulating at least the wire and the first and second inner terminal structures.

2. The method of claim 1, wherein the step of attaching the first and the second inner terminal structure comprises the step of attaching the first and the second inner terminal structure of phosphor bronze, and wherein the step of attaching the first and the second outer terminal structure comprises the step of attaching the first and the second outer terminal structure of brass to the first and the second inner terminal structures by resistance welding.

* * * * *